US005158340A

United States Patent [19]

Boda

[11] Patent Number: 5,158,340

[45] Date of Patent: Oct. 27, 1992

[54] TAILGATE MECHANISM FOR REAR LOADING COMPACTOR

[75] Inventor: Robert A. Boda, Ooltewah, Tenn.

[73] Assignee: McNeilus Truck and Manufacturing, Inc., Dodge Center, Minn.

[21] Appl. No.: 755,312

[22] Filed: Sep. 5, 1991

[51] Int. Cl.[5] ..... E05F 15/04; B65F 3/00

[52] U.S. Cl. ..... 298/23 M; 298/23 MD; 49/280

[58] Field of Search ..... 298/23 M, 23 MD, 23 S; 49/280, 279; 414/517, 519, 293

[56] References Cited

U.S. PATENT DOCUMENTS

| | | | |
|---|---|---|---|
| 3,257,012 | 6/1966 | Berolzheimer . | |
| 3,272,552 | 9/1966 | Park | 49/280 |
| 3,402,837 | 9/1968 | Palmer et al. . | |
| 3,440,763 | 4/1969 | O'Brien | 49/280 |
| 3,696,951 | 10/1972 | Toppins et al. . | |
| 3,819,071 | 6/1974 | Liberman . | |
| 3,899,091 | 8/1975 | Smith . | |
| 4,109,963 | 8/1978 | Sieving et al. | 298/23 M |
| 4,194,787 | 3/1980 | Williamsen | 298/23 M |
| 4,307,541 | 12/1981 | Farmer et al. | 298/235 X |
| 4,382,740 | 5/1983 | Smith | 414/293 |
| 4,427,231 | 1/1984 | Smith | 49/279 X |
| 4,568,237 | 2/1986 | Krause et al. | 414/519 |
| 4,627,783 | 12/1986 | De Filippi | 414/517 |
| 4,665,649 | 5/1987 | Hund | 298/23 S X |
| 4,877,366 | 10/1989 | De Filippi | 414/517 |

*Primary Examiner*—Frank E. Werner
*Assistant Examiner*—Brian K. Dinicola
*Attorney, Agent, or Firm*—Haugen and Nikolai

[57] ABSTRACT

This invention relates to an improved self-aligning automatic or remotely operated system for latching and unlatching the tailgate mechanism of a rear-loading refuse compacting truck which uses the tailgate lifting hydraulic cylinders in conjunction with an hydraulic cylinder-operated latch pin pulling and re-engaging mechanism which includes a self-centering, self-locking pin which cooperates to provide a simple yet very reliable automated latching and unlatching mechanism for the tailgate of a rear-loading refuse vehicle. The mechanism is designed to be retrofitted or be interchangeable with a manual system in a manner which facilitates easy conversion from one to the other involving the changing of a minimum of parts.

8 Claims, 4 Drawing Sheets

13
10
17
15
19
18
16
11
21
19
22
15
20
13
21
21
12
17
14

22
43
44
20
45
46
20
21
39
31
35
70
32
38
33
38a
40
41
38b
42
34
48
49
37
47
36

TAILGATE MECHANISM FOR REAR LOADING COMPACTOR

BACKGROUND OF THE INVENTION

1. Field of the Invention

The present invention is directed primarily to truck bodies designed specifically for refuse hauling trucks and, more particularly, to an improved tailgate mechanism for rear discharge hauling trucks, such as rear-loading refuse compacting trucks, which automates latching and unlatching of the tailgate to allow raising the tailgate and ejection or discharge of the contents by automated remote operation.

2. Description of the Related Art

Trucks for hauling various types of loads such as refuse pick-up trucks, rear discharge dump trucks, or the like, commonly include a truck chassis fitted with a distinctly configured separate body that is designed, built and installed on the chassis by a manufacturer other than the manufacturer of the chassis itself. The truck body is, then, specifically designed for the tasks to be accomplished. In the case of refuse trucks, it includes systems for receiving, compacting, hauling and discharging refuse materials and includes all the associated operating mechanisms. One very successful design of refuse hauling truck bodies is known as a "rear loader" and includes a refuse hauling reservoir accessible for loading and discharge from the rear of the vehicle. This system includes an hydraulic compacting mechanism which repeatedly compacts the refuse after each loading. In this manner, refuse eventually fills the available or usable reservoir volume extending from the front end back toward the rear of the body until no more material can be compacted.

The refuse holding reservoir is typically loaded through a rather large tailgate section which forms the closure for the rear of the refuse holding reservoir and includes a receiving hopper into which general refuse, cans or the like, can be dumped. The system further includes a packer blade mechanism which moves the refuse from the hopper into the body of the vehicle. Both the hopper and the packer blade mechanism are contained in and supported by a tailgate section.

The tailgate is hingedly connected to the truck body at the top rear of the truck body and may be raised to completely open the rear of the reservoir. The bottom of the tailgate, when lowered or in the closed position, is secured by latches to the rear structural supports on either side of the refuse truck body. The system is operated with the tailgate down and latched to the truck body except during the ejection of the accumulated contents at which time the tailgate is unlatched and swung upward and out of the way opening the entire rear of the refuse holding reservoir so that the collected material may be discharged from the body of the truck beneath the raised tailgate.

With a manual system, the truck operator must leave the cab to unlatch both sides of the tailgate from the truck body by hand at the landfill prior to backing up to the trash pit or landfill. This may also result in some spillage. He then backs up to the discharge pit and operates a pair of hydraulic cylinders connected between the tailgate and the truck body to raise the tailgate upward and operates the ejector mechanism to expel the contents of the reservoir. The hydraulic pressure is then relieved and the tailgate allowed to return to the normal position by gravity. The operator must again leave the cab to relatch the tailgate by hand.

The operation of the tailgate mechanism, thus, requires the driver of the vehicle to leave the cab twice, i.e., to unlatch both sides of the tailgate by hand prior to actuating the cylinders for lifting of the tailgate and, after ejection, to relatch the tailgate by hand. With regard to performing this sequence of operation, it has been found that most injuries to refuse workers with respect to the picking up, hauling and discharge of refuse occur in performing the functions related to emptying the storage container of the rear loading compactor at the transfer pit or landfill. This is occasioned, in no small part, by the necessity of the driver of the truck to leave his cab and operate the latching and unlatching mechanisms of the truck.

It will be appreciated that the ejection mechanism moves the entire forward wall of the truck body against which the refuse is compacted aft on an horizontal plane, in the manner of a plow blade, to expel the entire contents of the refuse volume during ejection. The ejector is operated by an hydraulic cylinder which mounts behind the cab and moves the ejector system fore and aft. The tailgate therefore must be capable of being raised to and held at a sufficient height so that the ejector can operate underneath without contacting the tailgate.

It would be advantageous if the ejection or discharge function, taking place at the landfill for trucks of the rear loading class, could be automated so that the operator of the vehicle would not be required to manually unlatch and relatch the tailgate. One such device is illustrated and described in U.S. Pat. No. 3,440,763 to O'Brien in which an hydraulic cylinder is utilized to operate a closure member. That system utilizes a bell crank and operating rod to engage and disengage a latch pin rigidly attached to the operating rod. While some success has been experienced with such a device, it is mechanically complex and requires repeated perfect alignment for the pin to be replaced when closing the tailgate. This realignment often fails necessitating manual assistance in the relatching of the tailgate.

A need remains for a rather simple, self-aligning automatic latching system which is more dependable. This is especially true for haulers serving an area that uses transfer stations including transfer pits. It would reduce spillage and dumping or ejection time. There is also a need for such a system which can readily replace a manually operated system in the manner of a retrofit.

SUMMARY OF THE INVENTION

The present invention provides an improved self-aligning automatic or remotely operated system for latching and unlatching the tailgate mechanism of a rear discharge truck body, such as a rear-loading refuse compacting truck. The mechanism is designed to be retrofitted or be interchangeable with a manual system in a manner which facilitates easy conversion from one to the other by simply changing a few parts.

One embodiment of the mechanism of the invention uses the tailgate lifting hydraulic cylinders to operate a two-way pivot arm, an hydraulic cylinder-operated pin pulling and replacing mechanism in conjunction with a self-centering, self-locking pin. The system provides a simple yet very reliable automated latching and unlatching mechanism for the tailgate of a rear-loading refuse vehicle. A guide member helps align the pin with opening in plates on the truck body and a resilient latch opening on the tailgate.

When the cylinder is actuated in a first direction to raise the tailgate, it causes a pivot or crank arm connected to the latch pin to pivot in a direction which causes the latch pin to be pulled upward to disengage the tailgate from the truck body. The tailgate is raised to the ejection position, the refuse ejected and the cylinder then actuated in the opposite direction to close the tailgate and thereafter cause the pivot arm to pivot in the opposite direction thereby replacing the latch pin. The alignment guide system and resilient tailgate latch assure proper latch pin replacement in relatching.

The mechanism of the present invention is further designed to replace a type of hand-operated, pivotal thread-locking mechanism by simply replacing or modifying a single acting hydraulic cylinder with a double acting cylinder, changing a pivotal connector operated by the hydraulic cylinder and replacing the screw-type, hand-operated locking mechanism with a self-centering pivotally connected vertical pin.

The system of the invention is designed so that the mechanical parts are shielded within truck strut supports to protect both the mechanism and those coming in contact with the truck from the majority of moving parts and pinch points.

BRIEF DESCRIPTION OF THE DRAWINGS

In the drawings, wherein like numerals are utilized to designate like parts throughout the same.

DETAILED DESCRIPTION

The detailed description depicts one or more specific forms of the present invention which are meant to be representative and by no means limiting or exhaustive as to the scope of the invention, and it is contemplated that other forms or variations might occur to those skilled in the art. It is contemplated that the invention is universally adaptable to be used for any latching tailgate or discharge gate of a class including rear discharge dump trucks, and the like, in which the tailgate needs to be unlatched for dumping o discharge and relatched for subsequent reloading.

It will also be appreciated that an important aspect of the automatic tailgate latching assembly of the present invention is directed to the ease of interchangeability or retrofit between the automatic and manual types of operation. No structural parts need be changed, and only a minimum number of mechanical parts need to be replaced leaving the structural members in place. This will become apparent with the following description of a preferred embodiment in accordance with the figures.

Figure 1:
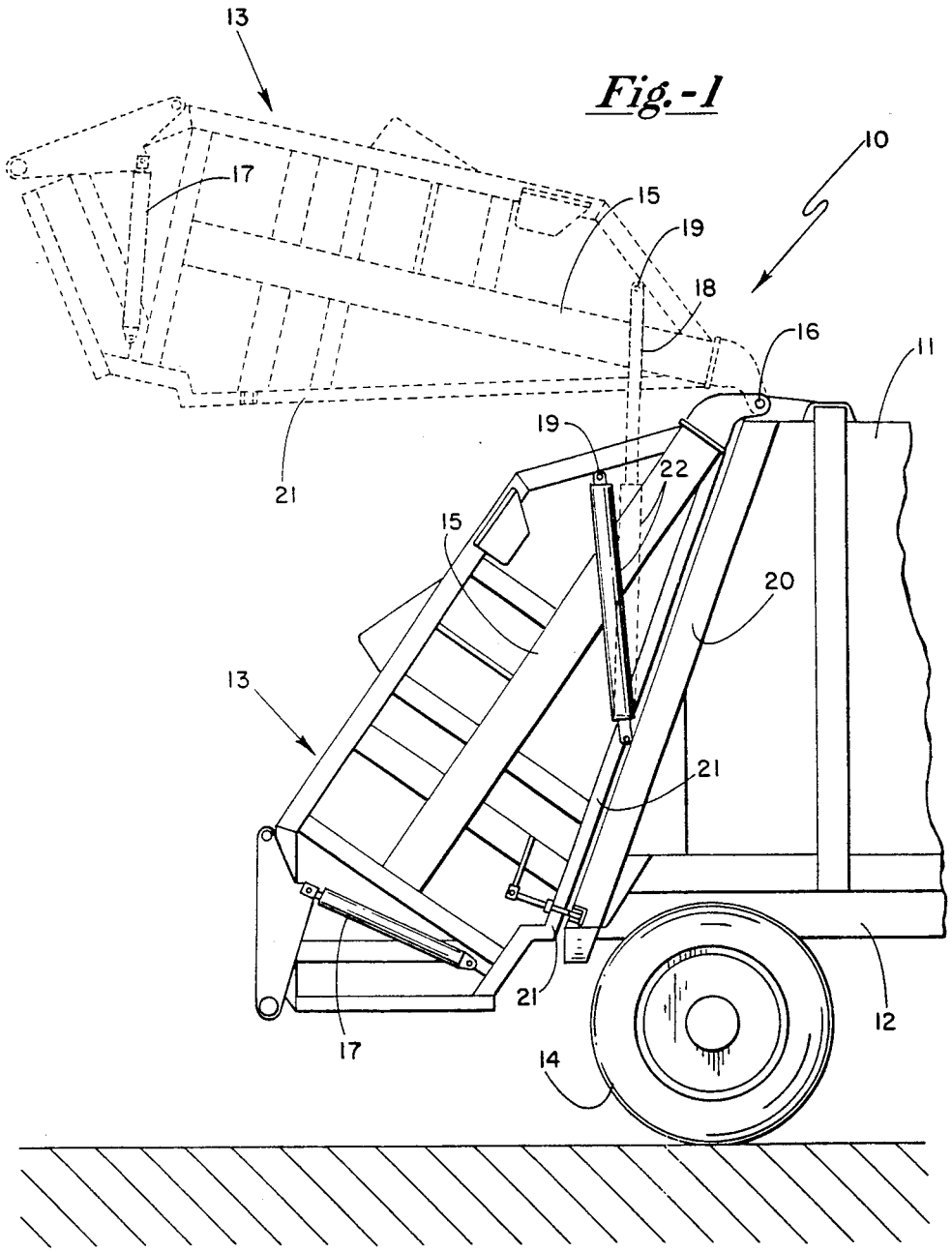
FIG. 1 is a fragmentary view of the rear portion of a typical rear-loading refuse vehicle equipped with a hand-operated tailgate locking mechanism and showing the alternate raised and lowered or locked positions of the tailgate assembly.

FIG. 1 depicts a fragmentary view of the rear portion of a refuse vehicle, generally at 10, in which a rear-loading refuse truck body 11 is carried by a heavy truck chassis 12 and which is equipped with a manually operated latching system. The truck chassis itself is normally of a class of conventional refuse-hauler chasses including a steerable front axle assembly complete with wheels, etc., which are well known and need not be illustrated for the purposes of the present invention. The tailgate assembly shown generally at 13 is cantilevered and extends a distance behind the rear wheel 14. The tailgate assembly is drawn in a closed position and alternatively illustrated with the fully open or refuse discharge position in phantom. As can be seen from FIG. 1, the tailgate assembly is a relatively, large, heavy and cumbersome mechanism which also forms the closure to the refuse storage compartment in the body 11. The tailgate section 13 includes rather heavy, substantially vertical primary structural members on each side as at 15 by means of which the tailgate section is hinged to pivot about a pair of large pivot pins as at 16. The tailgate assembly consists of a plurality of structural brace members connected by welded sheets to form a rather substantial structure.

The refuse storage compartment itself may be of any well-known type and includes a compacting system operated by cylinders as at 17 and ejection plate (not shown) which serves as a reaction member against which the refuse placed initially in the tailgate is compacted. The ejection plate serves to sweep the entire truck body clean from fore to aft when the tailgate assembly is completely raised during discharge of the refuse at a landfill. It is believed that the compacting mechanisms together with the ejection mechanisms are well known in the art, and their particular structure does not form any part of the present invention.

The latching mechanism needs to positively lock the tailgate assembly in place against the truck body in its lowered position and yet be configured to readily unlatch for opening at a landfill or other point of discharge. As indicated, the mechanism is a dual (two-sided) system but will be described with reference to the right rear sector depicted in FIG. 1. It should be kept in mind that an identical, oppositely disposed mechanism exists with regard to the left rear sector and that the two are designed to be operated in unison with respect to the automated embodiment as are the cylinders of the manual system. Further explanation should not be required as this is highly conventional.

Each latching mechanism operates to engage and disengage a generally tubular main brace as at 20 at the rear of the truck body near the bottom thereof with a structural tailgate member as at 21 substantially parallel thereto in the closed position. The tailgate assembly itself is raised and lowered by a pair of single action hydraulic cylinders, one of which is shown at 22.

Figure 2:
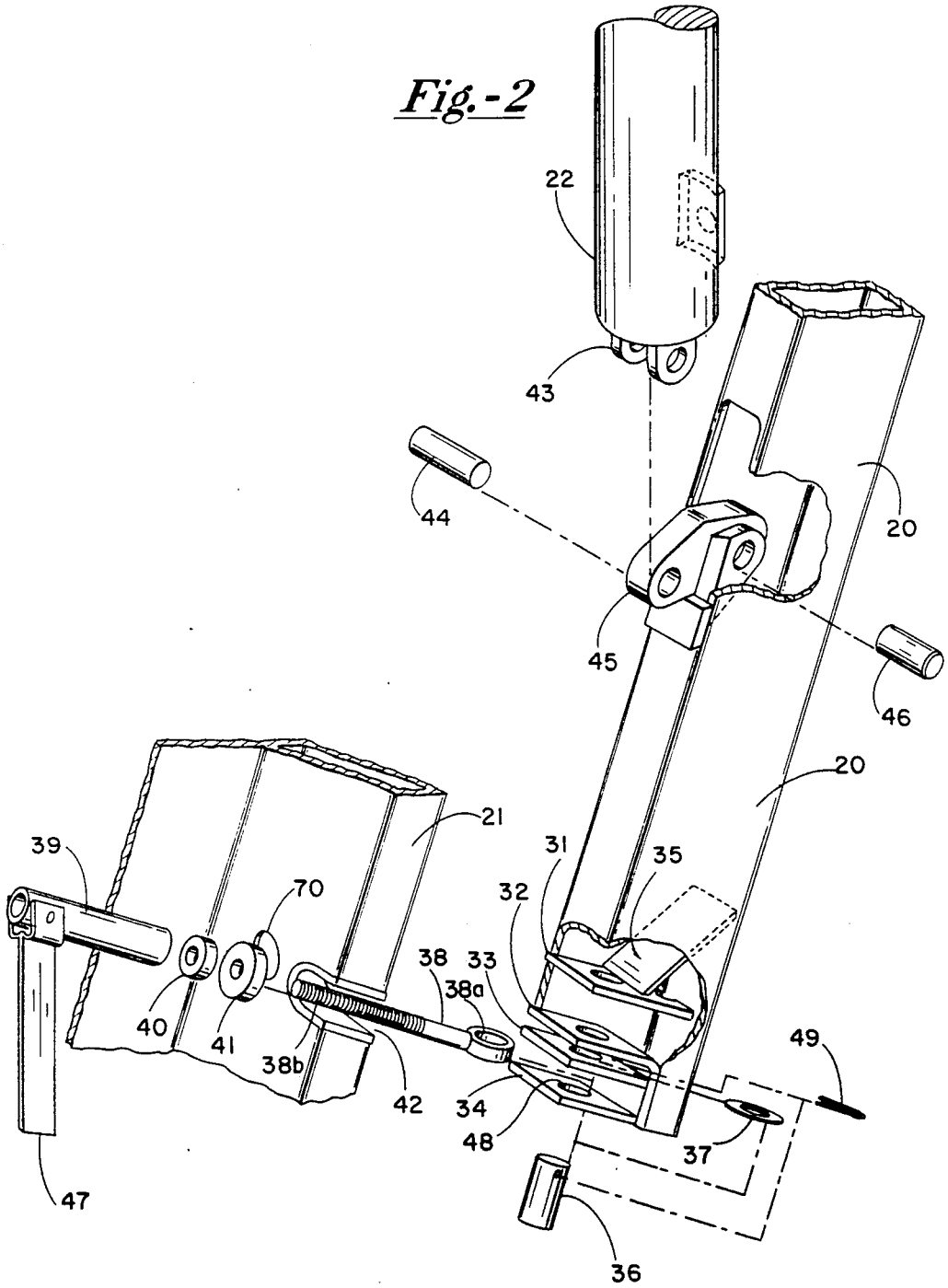
FIG. 2 is an enlarged, exploded detail perspective view with parts broken away of the manual configuration of the manual/automatic tailgate latching mechanism of FIG. 1.

The latching system illustrated in FIGS. 1 and 2 is a manually operated system and can better be seen in the exploded view of FIG. 2 and includes a fixed end having a plurality of plates 31-34 fixed in substantially spaced parallel relation inside the lower portion of the generally hollow tubular member 20, along with a deflection plate 35 used in conjunction with the automatic system. In the manually operated mode, a pin 36 and washer 37 with retaining cotter pin 49 are provided to rotatably fix the eye portion 38*a* of a locking eye bolt member 38. The locking member 38 has a threaded shaft which cooperates with an internally threaded cylinder 39 and pivoting operating handle 47 with washer 40 and thrust bearing 41 through a groove 42 in the tailgate member 21 to secure and unsecure the tailgate member 21 to the truck member 20. Piston rod 18 of the cylinder 22 (FIG. 1) is connected to the tailgate frame as by a swivel joint 19 and hinges 43 of the cylinder 22 itself are pivotally attached as by pin member 44 and pivot arm 45, by pin 46. This allows the cylinder to pivot as required during the raising and lowering of the tailgate.

The manually operated latch mechanism of FIG. 2 is operated by a handle 47 which is readily rotated to move the internally threaded cylinder member 39 along the length of threaded shank 38*a* of the modified eye bolt member 38 and is tightened to engage the member 21 through opening or slot 42, the members 20 and 21 are thus brought into close proximity. After loosening or backing-off the member 39 utilizing the handle 47, the member 38 is free to pivot away from the opening 42 about the permanent pin 36 and the member 21 thereby allowing the member 21 and the tailgate to swing free of the truck body and away from member 20. This is done by extending the piston rod member of the cylinder 22. The cylinder 22 is a single acting cylinder and the weight of the tailgate itself is utilized to effect contraction of the cylinder and closing of the tailgate using fluid damping effects, once the cylinder 22 is depressurized. It will be appreciated that the system includes a pair of such cylinders and a pair of the hand-operated latching mechanisms.

Figure 3A:
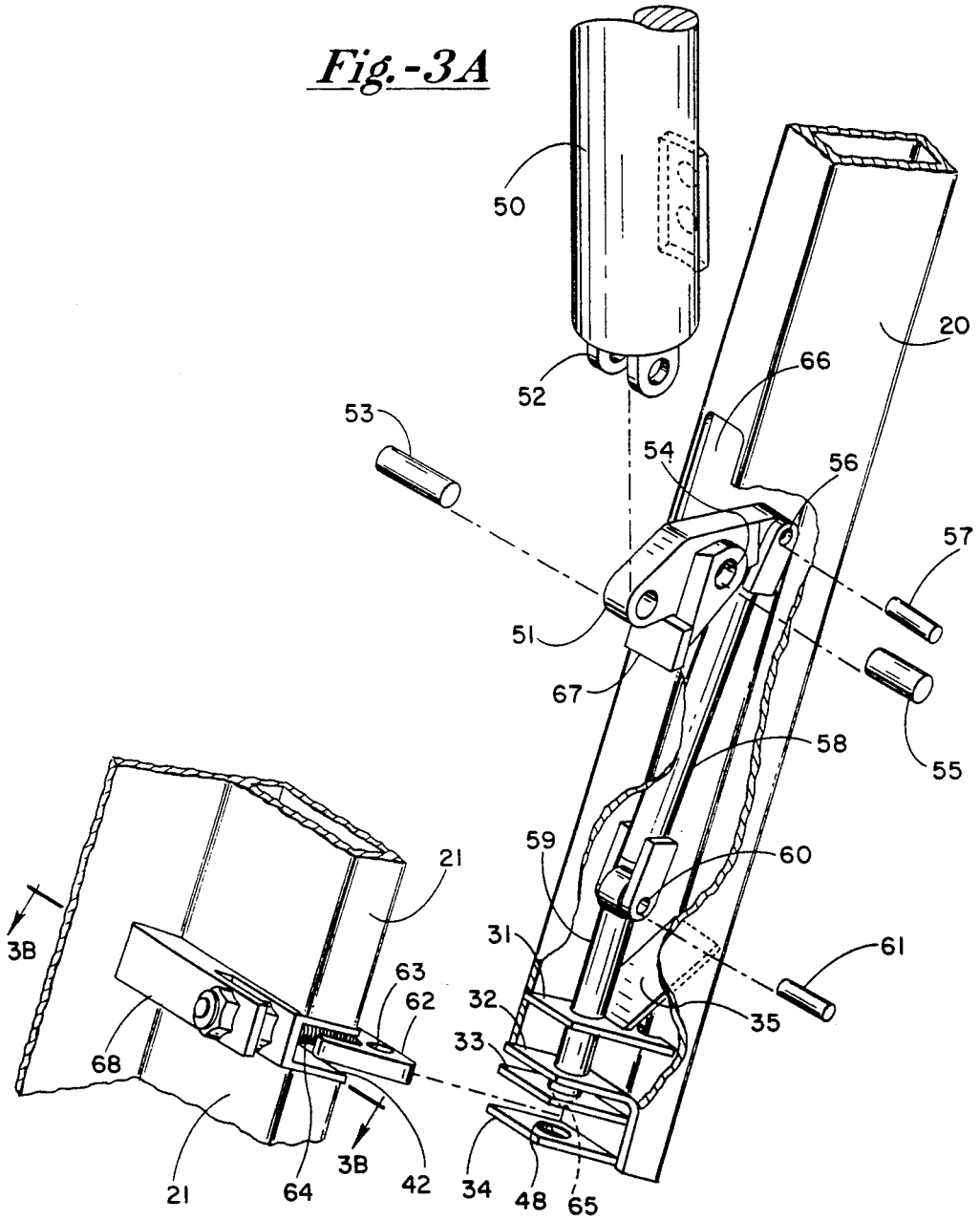
FIG. 3A is an exploded perspective view with parts broken away of an embodiment of the automated version of the tailgate latching mechanism of FIGS. 1 and 2 in accordance with the invention.
Figure 3B:
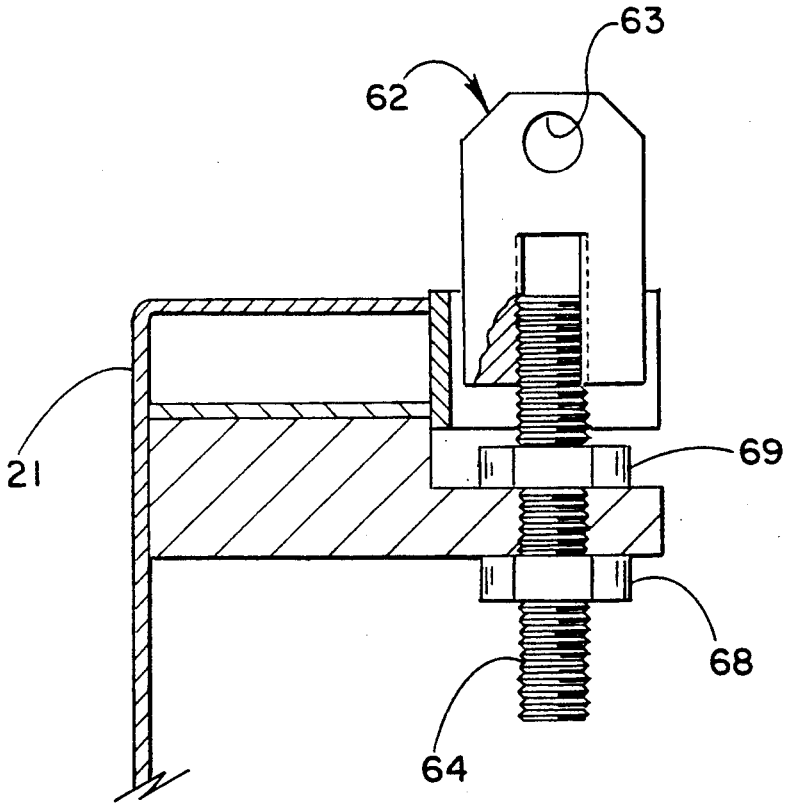
FIG. 3B is a detail section view along line 3B—3B of FIG. 3A.

The automatically operated embodiment of the improved tailgate latch mechanism of the invention is illustrated by FIGS. 3A and 3B. The automatically operated embodiment utilizes parts readily interchangeable with those for the manual system such that the automatic system is readily retrofitted without structural modifications to the tailgate or the truck body. The system includes a double acting cylinder 50, which may be a modified single acting cylinder, hinged to one end of an operating or crank arm 51 by hinges 52 and pin 53. The operating arm in accordance with the automated version is further pivoted at 54 utilizing pin 55 and pivotally connected at 56 by a pin 57 to a latch pin actuator rod member 58. The member 58, in turn, is pivotally connected to a latch pin 59 via a pivotal joint at 60 utilizing a wrist pin 61. The latch pin 59 is designed to operate in a generally vertical manner with respect to the series of concentrically aligned openings 48 in the members 31-34 but does not depend on gravity for operation. In the automated version, the slot 42 and structural member 21 of the tailgate portion are provided with an engageable/disengageable latch mechanism 62 which is provided with an opening 63 and a threaded adjustable member 64. The mechanism is further fixed into the slot 42 in member 21 as shown using threaded nuts 68 and 69. The latch pin 59 carries a pointed tip as at 65 which, with alignment plate 35 and spring member 64 of latch 62, allows the pin to self-align with the hole 48 and with the hole 63 to readily engage the tailgate when the gate is in the down position.

In operation, starting with the tailgate closed, members 21 and 20 adjacent and the pin 59 engaging the lock mechanism 62 between plates 33 and 34 through hole 63. Hydraulic fluid pressure is applied to the cylinder 50 so as to extend the piston rod member 18. Because the latch pin is still in position, the tailgate cannot move so that the cylinder/piston combination puts downward pressure on the pivot pin 53 causing the arm 51 to pivot in a direction that results in pulling the pivot pin 59 upward and releasing the latch 62. When crank arm 51 strikes stop 67, the tailgate swings up as the cylinder/-piston combination further lengthens, reaching its maximum when the tailgate is fully open. To close the tailgate assembly, the dual action piston/cylinder combination is operated in the opposite direction to retract the piston rod thereby reducing the length of the piston rod/cylinder combination until the tailgate is fully closed and thereafter the system operates to pull up on pin 53 thus pivoting the cylinder pivot arm 51 in the opposite direction, to push or lower the latch pin 59 back through the holes 48 and engage the latch 62 through hole 63.

It will be appreciated that the threaded rod member 64 allows an amount of adjustment in the latch 62 such that holes 63 can be aligned with the tip 65 of the latch pin 59. The deflector plate 35 guides the latch pin 59 into and through the holes in plates 31 and 32 so that the system becomes completely self-aligning. It will further be appreciated that the entire mechanism, except for the latch 62 and part of pivot arm 51, is contained within the hollow tubular member 20 to assure a clean operation of all pivotal joints and reducing the possibility of forcing matter clogging the system or injury to anyone in the vicinity when the system is operated. The system can easily be assembled through opening 66 in the hollow member 20.

Ready interchangeability between the manual and automatically operated systems exists such that one can easily retrofit an automatically operated embodiment into a truck that, for example, was purchased with the manual system. In this regard, the two-hole crank arm 50 can be readily removed and replaced by the crank arm and pin system including crank arm 51, latch pin operating member 58 and latch pin 59 as a preassembled unit can be simply inserted through the opening 66 in the member 20 and the pin 55 fixed in the opening 54. The self-centering and aligning system using plate 35, already in place, will cause the latch pin 59 to align with the openings 48 and drop through the plates 31 and 32. Of course, the permanent latch pin of the manual system 36 can be readily removed by removing cotter pin 49 and dropping the pin 36 allowing removal of the member 38 and handle-operated tightener 39. This is readily replaced in the groove of structural member 21 by the latch system 62. In addition, the double acting cylinder 50 readily replaces the single acting cylinder 22 or the cylinder 22 is readily modified to complete the changeover. It should be noted that no structural changes to the system are required, and only hardware items are added or deleted. Of course, if desired, one can just as well change from automatic to manual by reversing the process.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. An automated self-aligning tailgate latching system for a refuse compacting truck having a refuse storage truck body open at one end and a tailgate pivotally hinged to open and close one end of the refuse storage truck body, the latching system comprising:

a pair of fluid operated cylinders for pivoting the tailgate connected between the truck body and the tailgate one located on each side thereof;

a pair of latch pins, each one having a connected end operatively connected to each fluid cylinder and having a free latching end;

a pair of tailgate latch means, one attached to each side of the tailgate, each tailgate latch means containing a latch member having an opening adapted to receive and engage a respective one of the latch pins;

a pair of tailgate latch securing means one fixed to each side of the truck body adapted to receive a respective tailgate latch member and having an opening therein adapted to receive and retain the respective latch pin which, in conjunction with the opening in the respective tailgate latch member, thereby latches the tailgate to the truck body upon insertion of the latch pin;

a pair of latch pin operating mechanisms, each one including pivoting crank arm means connected between the respective fluid operated cylinder and the respective latch pin and including a connecting rod member connected between the crank arm and the respective latch pin and adapted to pull and insert the respective latch pin longitudinally in accordance with the operation of the connected fluid operated cylinder thereby unlatching and latching the tailgate and the truck body in accordance with cylinder operation;

a pair of self-aligning guide means one disposed to assure proper insertion of each latch pin, each guide means further comprising:

pivot means attached to the connected end of the latch pin allowing the lateral adjustment of the latching end of each latch pin;

alignment means comprising a pair of longitudinally spaced aligned openings for sequentially receiving and aligning the latch pin;

alignment guide member for guiding the latching end of the latch pin into the alignment openings;

wherein, upon replacement, the latch pin is aligned through the guide means prior to engaging the securing means and tailgate latch means;

wherein the operation of the fluid cylinders to lift the tailgate first causes each pivoting crank arm to pivot in a first direction thereby causing the latch pin connecting rod to pull the respective latch pin and unlatch the tailgate prior to the cylinder exerting force to raise the tailgate itself; and wherein the reverse operation of the fluid cylinder lowers the tailgate and thereafter causes the pivot arm to pivot in the reverse direction and replace the latch pin.

2. The tailgate latching system of claim 1 wherein the alignment means of the self-aligning guide means further comprises a pair of spaced, substantially parallel plates having aligned latch pin receiving openings adapted to receive and align a tailgate latch pin for replacement in the tailgate latch securing means and wherein the alignment guide member is a slanted plate member which guides the latching end of the respective latch pin into the pin receiving openings.

3. The tailgate latching system of claim 2 wherein each tailgate latch securing means further comprises a pair of spaced, substantially parallel plates having aligned latch pin receiving openings and adapted to receive the tailgate latch means therebetween.

4. The tailgate latching system of claim 2 wherein each tailgate latch means further comprises adjustment means for further aligning the opening therein with the openings in the tailgate latch securing means.

5. The tailgate latching system of claim 4 wherein the adjustment means of the tailgate latch means is a threaded rod means.

6. The tailgate latching system of claim 4 wherein the tailgate latch receiving means, latch pin, latch pin operating means and self-aligning guide means are substantially shielded by being contained in an hollow support member of the truck body.

7. The tailgate latching system of claim 1 wherein each tailgate latch securing means further comprises a pair of spaced, substantially parallel plates having aligned latch pin receiving openings and adapted to receive the tailgate latch means therebetween.

8. The tailgate latching system of claim 1 wherein the tailgate latch securing means, latch pin, latch pin operating mechanisms and self-aligning guide means are substantially shielded by being contained in an hollow support member of the truck body.

* * * * *